US005115928A

United States Patent [19]

Drummond, Jr.

[11] Patent Number: 5,115,928

[45] Date of Patent: May 26, 1992

[54] CONVERTIBLE CHILD-RESISTANT CLOSURE ASSEMBLY

[76] Inventor: Archie G. Drummond, Jr., 928 Mallard Ct., Palatine, Ill. 60067

[21] Appl. No.: 625,867

[22] Filed: Dec. 11, 1990

Related U.S. Application Data

[63] Continuation-in-part of Ser. No. 538,206, Jun. 14, 1990, abandoned.

[51] Int. Cl.[5] ..... B65D 55/02

[52] U.S. Cl. ..... 215/219; 215/216; 215/218; 215/220; 215/221

[58] Field of Search ..... 215/220, 204, 207, 215, 215/216, 218, 219, 221, 301, 302

[56] References Cited

U.S. PATENT DOCUMENTS

| | | | |
|---|---|---|---|
| 3,160,301 | 12/1964 | Milbourne | 215/219 |
| 3,338,444 | 8/1967 | Velt | 215/220 |
| 3,472,411 | 10/1969 | Turner | 215/220 |
| 3,520,435 | 7/1970 | McIntosh | 215/220 |
| 3,625,387 | 12/1971 | Schaefer . | |
| 3,710,970 | 1/1973 | Elfline | 215/219 X |
| 3,722,727 | 3/1973 | Gach . | |
| 3,743,127 | 7/1973 | Morceau | 215/221 |
| 3,764,033 | 10/1973 | Smith et al. . | |
| 3,776,407 | 12/1973 | Cistone . | |
| 3,782,604 | 1/1974 | Kessler . | |
| 3,795,337 | 3/1974 | Nozawa et al. . | |
| 3,795,338 | 3/1974 | Swartzbaugh et al. . | |
| 3,797,688 | 3/1974 | Porcelli et al. . | |
| 3,843,006 | 10/1974 | Naito et al. . | |
| 3,887,099 | 6/1975 | Gillman et al. . | |
| 3,888,373 | 6/1975 | Gach et al. . | |
| 3,946,889 | 3/1976 | Gach | 215/219 |
| 4,223,794 | 9/1980 | Morris . | |
| 4,353,473 | 10/1982 | Morris . | |
| 4,371,088 | 2/1983 | Gach | 215/220 |
| 4,501,370 | 2/1985 | Kelley | 215/219 |
| 4,854,459 | 8/1989 | DeJonge | 215/220 |
| 4,957,210 | 9/1990 | Kusz | 215/220 |

*Primary Examiner*—Stephen Marcus
*Assistant Examiner*—Vanessa Caretto
*Attorney, Agent, or Firm*—Dressler, Goldsmith, Shore, Sutker & Milnamow, Ltd.

[57] ABSTRACT

A convertible child-resistant closure assembly is described herein. It includes a closure and shell. The shell mounts a latching key and the closure provides a complementary latch. An alignment structure provides for aligning the latch and key for movement of the latching key from a mode in which the key is inactive to a mode in which it engages the latch to inactive the child-resistant function of the closure. In that position the shell and closure are corotatable in both clockwise and counterclockwise directions. Spring fingers may be provided to elevate the shell relative to the closure to provide an additional child-resistant function. The latching key may be hingedly or slideably secured to the shell.

18 Claims, 5 Drawing Sheets

Fig. 1
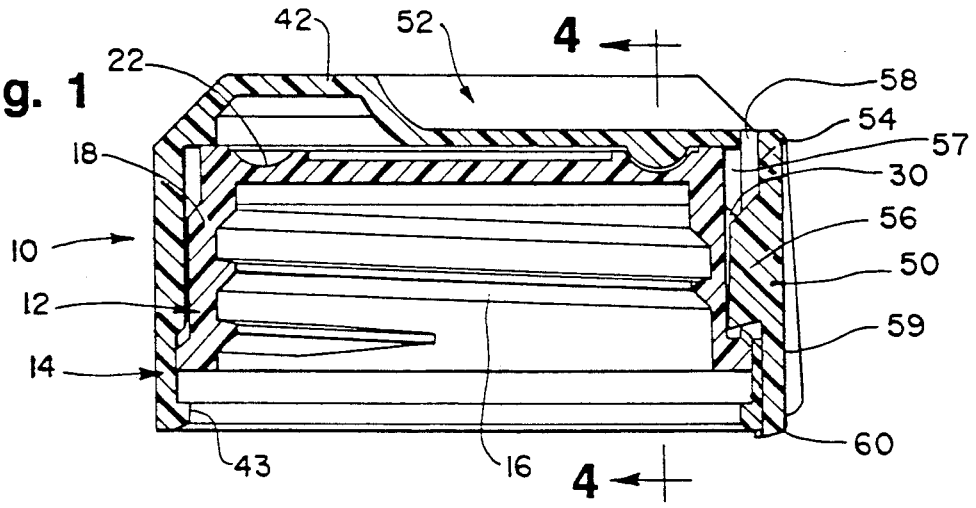
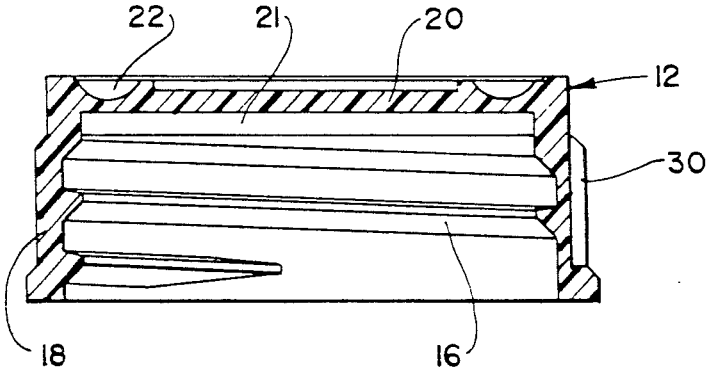
Fig. 2
Fig. 4
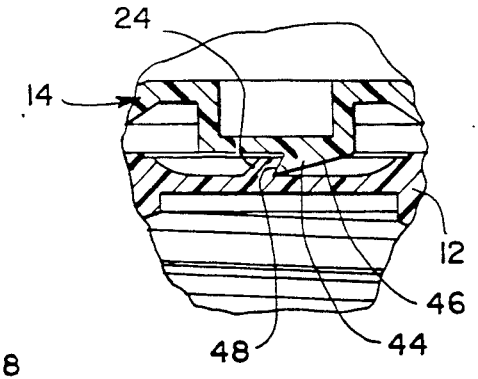
Fig. 3
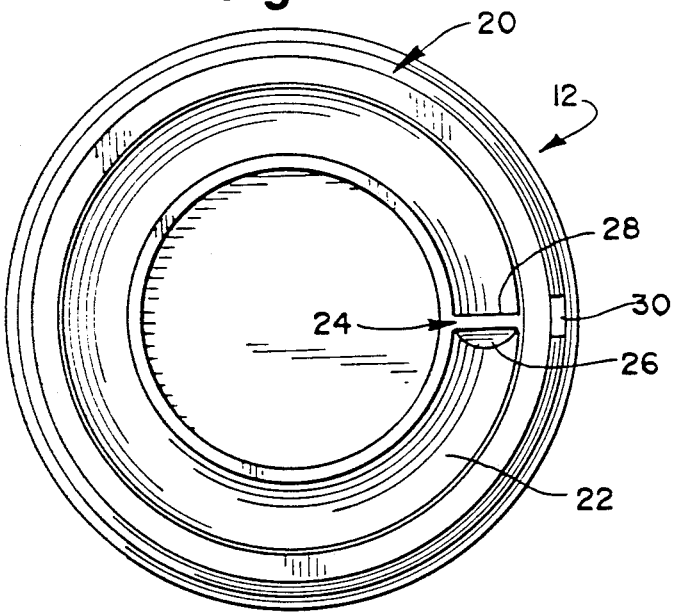

CONVERTIBLE CHILD-RESISTANT CLOSURE ASSEMBLY

This application is a continuation-in-part of application Ser. No. 07/538,206 filed on Jun. 14, 1990 now abandoned.

BACKGROUND OF THE INVENTION

Child-resistant closures are regularly used with a number of bottled products in the marketplace. They are frequently difficult to use, particularly by older people or others lacking muscular finger strength or suffering from arthritis, or for those handicapped with poor or failing eyesight, making it difficult to locate the alignment point used on some of the child-resistant systems.

Some child-resistant closure systems require the dual action of pushing down and rotating the cap simultaneously which is difficult, when fingers lack the strength to both push and turn with force at the same time. Another system requires the alignment of a feature on the closure and one on the container, followed by pushing or pulling the closure upward with fingertips or fingernails. Because with this type the containers and closures are made of different materials and by different molding processes, the dimensional tolerances between the two pieces can range broadly enough so that in extremes of tolerance, with the container at an extreme plus tolerance and the closure at an extreme minimum tolerance, rotating and lifting the closure can be very difficult. Another system requires pinching the sides of the closure while turning it. Yet another system requires pushing downward on the top of the closure to deflect a tab upwardly which serves as a pull-up device.

Variations of the first two above-described closure systems are commonly found on prescription containers and over the counter medicines such as analgesics, vitamins and cold remedies. In the analgesic category only one count size within a brand is typically available with a non-child-resistant closure, and is generally not the most economical of all the sizes available.

Elderly people and others having handicaps making it difficult to use many child-resistant closures make up a large part of the prescription and analgesic market. It is predictable that they are, in large measure, frustrated by the existing closures, resulting in closures being loosely replaced or by leaving closures off the associated containers entirely. Because of the demographic make-up of this elderly and handicapped market, child-resistant closures are often not necessary. Despite that, market realities and desires dictate the use of such closures.

The objective of this invention is to provide a child-resistant closure which can be easily changed between a security engaged, child-resistant mode and a security disengaged, non-child-resistant mode, and to provide for the closure to be retained in the security disengaged mode if desired. The facility of having the option to easily use either mode could preclude leaving a container unsecured, because of the difficulty attendant its reopening, even when needed from a safety standpoint.

SUMMARY OF THE INVENTION

In accordance with the present invention an improved convertible child-resistant closure assembly is provided. The enclosure includes a threaded closure and an overlying outer shell mounting the closure therewithin. A latching key on the shell is provided and is movable between an inactive child-resistant position and a converted, active non-child-resistant position. Complementary latching means are provided on the closure for releasably engaging the latching key in the active position, in which the shell and closure are corotatable in both clockwise and counterclockwise directions. When the latching key is in the inactive position, the shell and the closure are not corotatable in the counterclockwise direction. Desirably the latching key is hingedly secured to the shell and preferably it is integrally formed with the shell. Alternatively the latching key may be slideably secured to the shell for sliding movement along the outer surface of the shell for movement between the active and inactive positions.

The complementary latching means may comprise recess means defined by the closure. In a preferred form the closure and shell define complementary interengaging aligning means for aligning the latching key and complementary latching means in the converted active, non-child-resistant position. The aligning means preferably comprises respective stops on the upper surface of the closure and a confronting surface of the shell. The stops may have confronting inclined surfaces to prevent relative vertical movement of the stops when the latching key and latching means are in the active position. Alternatively the stops may have interdigitating fingers to prevent such movement.

The stops also may function to permit the closure and shell to corotate in the clockwise direction, but to prevent corotation thereof in the counterclockwise direction.

The closure is usually of a height less than the height of the overlying shell, thereby to permit relative vertical movement therebetween. Spring means may be provided on the closure or shell for maintaining the stops in a vertically spaced relationship, whereby a downward force on the outer shell will overcome the force of the spring means to permit the stops to be moved into a non-vertically spaced relationship. Preferably the spring means comprises a plurality of resiliently deflectable spring fingers.

Further objects, features and advantages of the invention will become apparent from the following description and drawings.

BRIEF DESCRIPTION OF THE DRAWINGS

FIG. 1 is a cross-sectional view of a convertible child-resistant closure assembly in accordance with this invention and which shows a latching key engaged in non-child-resistant position;

FIG. 2 is a similar cross-sectional view of the threaded closure of FIG. 1;

FIG. 3 is a top plan view of the threaded closure of FIG. 2;

FIG. 4 is a fragmentary cross-sectional view of FIG. 1 taken substantially along line 4—4 of FIG. 1;

DESCRIPTION OF THE PRESENTLY PREFERRED EMBODIMENTS

Figure 8:
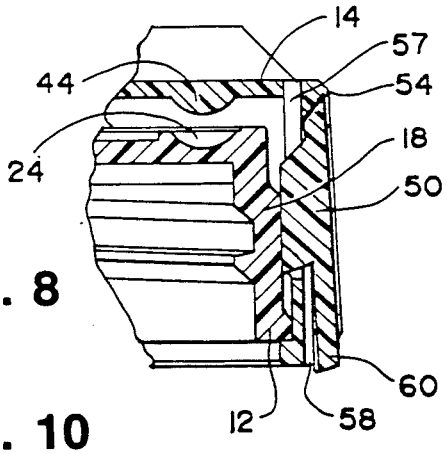
FIG. 8 is a fragmentary cross-sectional view similar to FIG. 1 showing the key in an intermediate position.

Referring first to FIGS. 1-8, a convertible child-resistant closure assembly 10 in accordance with the present invention may comprise a two-piece assemblage of a closure such as a threaded closure 12 and an overlying outer shell 14. The outer shell is preferably molded of polypropylene and the threaded closure of polyethylene, or other suitable plastic materials. The shell 14 mounts the closure therewithin and is rotatable on and relative to the closure 12. As may be appreciated, the height of the closure 12 is less than the inside height of shell 14 so that the shell may be moved vertically relative to the closure, as illustrated by FIGS. 1 and 8.

Closure 12 defines threads 16 which are adapted to be threadingly secured to the neck of a container (not shown) which is adapted to contain tablets or other solid medication, such as capsules, as well as fluids such as medications, petroleum distillates, caustics, poisons, etc.

The closure 12 is generally cylindrical and defines a side wall 18 mounting threads 16 and a top 20. A compressible liner 21 may be used as well. Top 20 may define an annular groove 22, which, as best seen in FIGS. 2 and 3, also defines a stop 24 having a sloping surface 26 on the counterclockwise side of stop 24 and a surface 28 which is preferably slightly forwardly inclined on the clockwise side. The side wall 18 also defines recess means such as a latching slot 30 positioned in a predetermined location relative to the stop surface 28, such as in alignment therewith as seen in FIG. 3.

Figure 5:
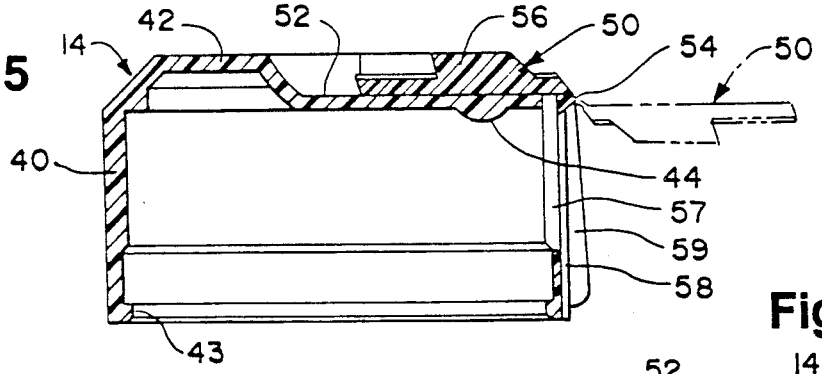
FIG. 5 is a cross-sectional view of the outer shell of FIG. 1 showing the key in two positions.
Figure 6:
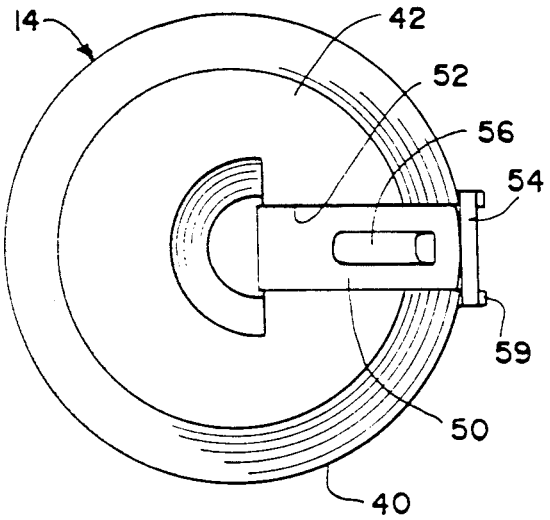
FIG. 6 is a top plan view of the shell of FIG. 5.
Figure 7:
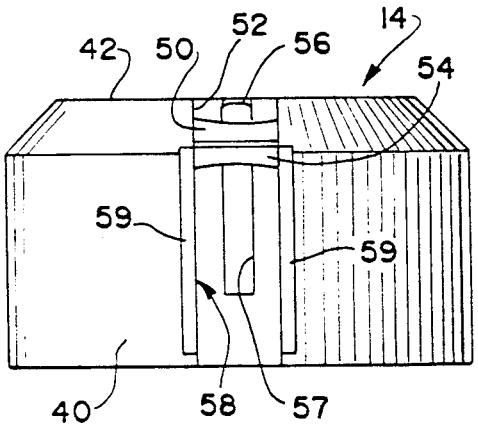
FIG. 7 is a right side elevational view of the shell of FIG. 6.

The outer shell 14 is adapted to closely fit on closure 12 and to rotate relative thereto. As best seen in FIGS. 1, 5 and 6, outer shell 14 comprises a generally cylindrical side wall 40 and a top 42 overlying the closure top 20. The shell 14 also defines a retaining flange 43 to maintain the relationship of shell 14 and closure 12 and to prevent them from being separated, one from the other. The lower, inner side of the shell top 42 facing the closure top 20 inter alia provides a depending stop or drive member 44 which has a sloping surface 46 on the counterclockwise side and a surface 48 which is inclined complementary to surface 28 on the clockwise side of stop 24. Thus, when the closure assembly 10 is to be used to secure and tighten the closure on a bottle via threads 16, the vertical surfaces engage as shown in FIG. 4 for movement in a clockwise direction. The surfaces 28, 48 are somewhat inclined to facilitate tightening of the closure on a bottle as well as to keep the threaded closure and shell from slipping past each other vertically when the key is in latching slot 30. However, on their counterclockwise sides the surfaces 26, 46 are sloping or sufficiently inclined, such that unthreading of the closure 12 from the bottle is exceedingly difficult, i.e., the sloping surfaces simply ride over each other. Preferably the inclines of surfaces 26, 46 do not match to minimize the possibility that frictional engagement might assist in defeating the child-resistant function of the closure assembly.

The stop 24 and drive member 44 serve also as an aligning means to provide a locating or aligning function in which latching means are aligned for latching engagement. As may best be seen in FIG. 5 shell 14 hingedly mounts an integrally formed latching or locking key 50. Key 50 is normally disposed in a notch 52 on the top of shell 14, preferably in a snug fit sufficient to keep it from being jarred loose. In that position key 50 is inactive and the closure assembly 10 is in its child-resistant or secure mode.

Latching key 50 is pivotally movable from its inactive or storage position in notch 52 about a hinge, such as living hinge 54, through intermediate positions as illustrated in dotted line in FIG. 5, to a position in which it may bear against the side wall 18 as shown in FIG. 8, and finally to a converted, active slot engaging position best shown in FIG. 1. The intermediate dotted line position of FIG. 5 also represents the position of the key as it is molded. In the slot engaging position of FIG. 1, latch 56 which projects inwardly of key 50 extends through shell opening 57 and is positioned in latching slot 30, and the key 50 is preferably releasably held in a recess 58 in a friction fit, or by a retaining undercut (not shown).

Desirably the upper surface portions of key 50 is slightly curved in cross-section (see FIG. 7) to conform to the curvature of the recess 58. When latch 56 is positioned as described, it interlocks the closure 12 and shell 14 so that they are corotatable in both clockwise and counterclockwise directions, i.e., they are in a security disengaged, non-child-resistant mode relative to each other. In that mode the closure assembly acts like an ordinary threaded bottle closure and permits easy opening and closing of the bottle. Desirably the shell 14 may define an extended recess 58 at the outer surface of side wall 40 so that when the latch 56 is in the position as shown in FIG. 8, against the side wall 18 of closure 12, away from latching slot 30, the remainder of the key 50 lies within the recess 58. A portion of opening 57 extends through the top of the shell and recess 58 extends to the bottom of the shell 14 as best seen in FIG. 5 to facilitate manufacture of the shell in a two-piece mold. Further, the key 50 and recess 58 are proportioned so that the key 50 may not be pushed inwardly with sufficient force, say in the position of FIG. 8, to remove the shell from the closure 12. The bottoms of the side wall portions 59 of recess 58 terminate above the bottom end of the shell and are curved to facilitate pushing the key into the latching slot.

To return the closure assembly to its child-resistant, security engaged mode, the key 50 needs simply to be retracted from the latching slot 30 as by engaging the end 60 of the key with a finger, lifting the key free, and then returning it to the position of FIG. 5.

To locate the latch 56 in a position in which it confronts latching slot 30, the shell 14 is rotated in a clockwise direction. This continues until the stops, namely the stop 24 and drive member 44, engage, at which time the latch 56 confronts the latching slot 30 and may be pushed home thereunto. Alternatively, the key 50 may be moved to the position of FIG. 8 and then the shell may be rotated, while pushing on the key until it engages the slot 30 at which time the latch 56 may be pushed home into the slot 30.

Figure 9:
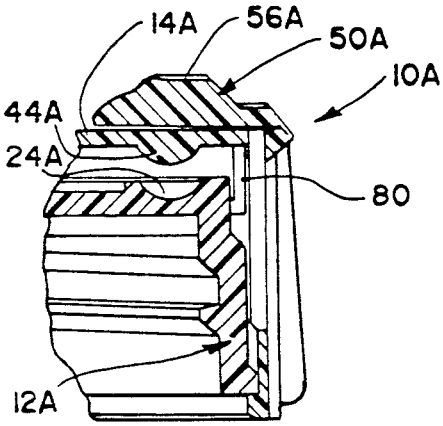
FIG. 9 is a fragmentary view of a modified closure assembly of the present invention.
Figure 10:
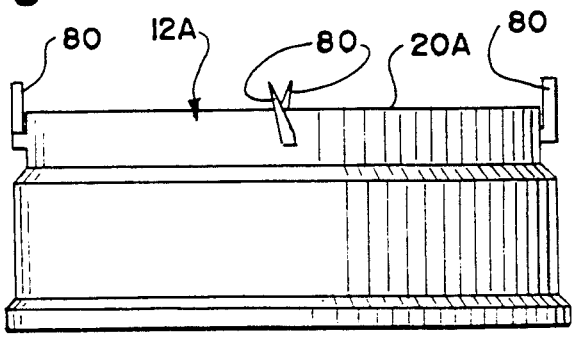
FIG. 10 is a side elevational view of the threaded closure assembly of FIG. 9.

It may be desirable to enhance the child-resistance of a closure assembly 10A which is generally similar to that of FIGS. 1-8, to provide spring means or a plurality of resiliently deflectable spring fingers 80 as shown in FIGS. 9 and 10. These may be positioned on either the closure or shell, although as shown in the drawings they are on the closure 12A projecting upwardly beyond the top 20A of the closure 12A. These spring fingers 80, which preferably are at least three in number to maintain the separation of the closure and shell, as shown in FIGS. 9 and 10 tend to maintain the outer shell 14A in the elevated position relative to closure 12A shown. Thus they prevent engagement of the stop 24A and drive member 44A (positioned and structured as shown in FIGS. 1-8) to insure that they do not engage in either direction of rotation without requiring an additional movement. This enhances the child-resistant function of closure assembly 10A. To overcome the child-resistant function of this modified closure, as well as to threadingly secure it to a bottle, it is necessary to push down on the shell to engage stop 24A and drive member 44A, as well as to align a complementary latching slot and key latch 56A for converting the closure assembly 10A to the security disengaged, non-child-resistant mode.

It will be apparent that a variety of means can be used for aligning the closure and shell for insertion of the key. Thus, for example, alignable holes, colored spots and the like may be incorporated. Further, it will be apparent from the foregoing that the aligning stop may be located elsewhere than on the top of the closure and may be separate from the means used for threadingly engaging the closure with an associated threaded bottle neck. Additionally, it is clear that plural alignment stops and latching slots may be provided to eliminate the need in the embodiments shown of rotating the shell as much as 360 degrees to align them. Furthermore the shapes of the stop and drive member are not restricted to the particular configurations illustrated.

Referring now to FIGS. 11-14, a further convertible child-resistant closure assembly 110 which is similar to assembly 10 as shown in FIGS. 1 to 8 comprises a two-piece assemblage of a closure such as a threaded closure 112 and an overlying outer shell 114. The outer shell is preferably molded of polypropylene and the threaded closure of polyethylene, or other suitable plastic materials. The shell 114 mounts the closure therewithin and is rotatable on and relative to the closure 112. As may be appreciated, the height of the closure 112 is less than the inside height of shell 114 so that the shell ma be moved vertically relative to the closure.

Figure 12:
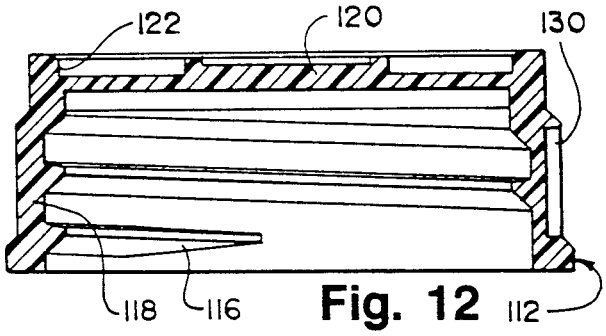
FIG. 12 is a cross-sectional view of the threaded closure of FIG. 11.
Figure 13:
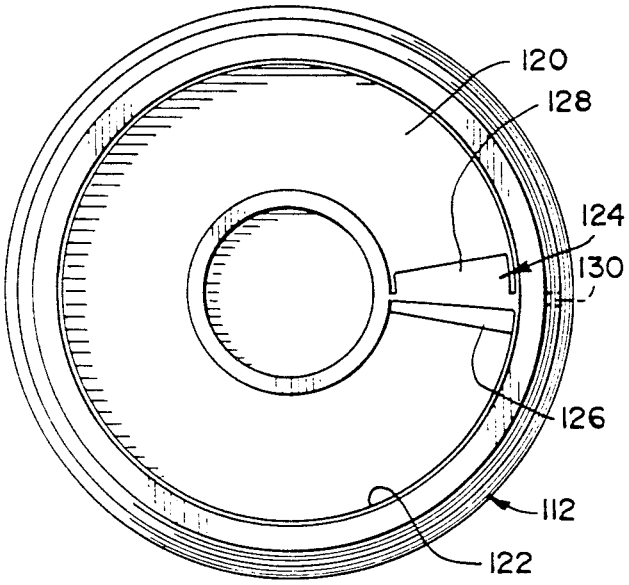
FIG. 13 is a top plan view of the threaded closure of FIG. 12.
Figure 14:
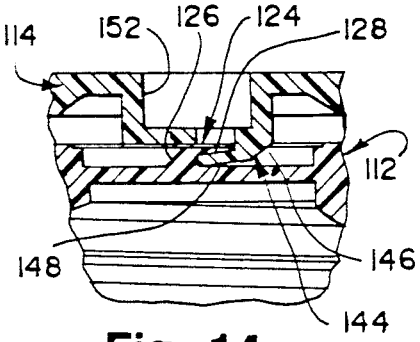
FIG. 14 is a fragmentary cross-sectional view of FIG. 11 taken substantially along line 14—14 of FIG. 11.
Figure 15:
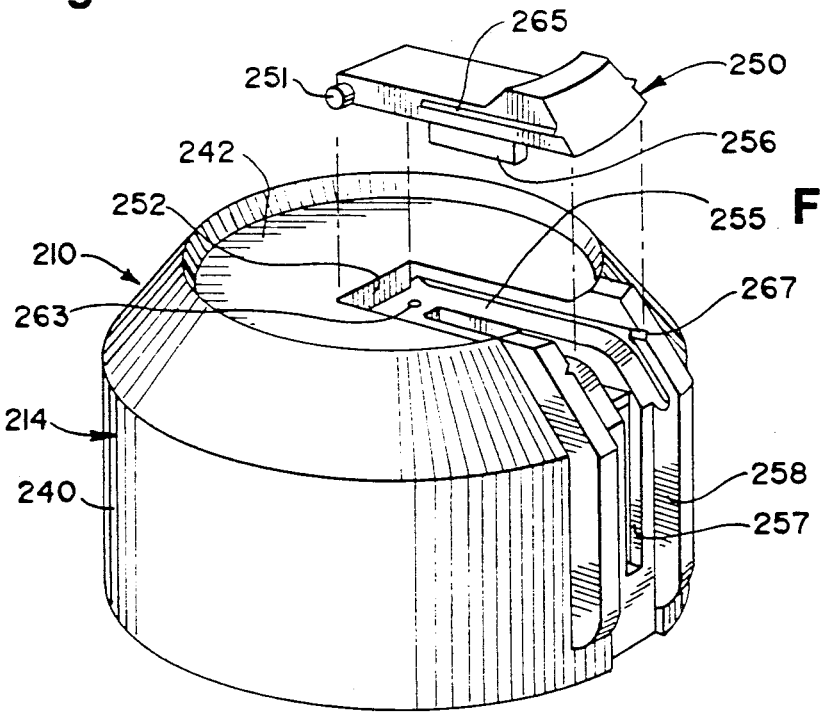
FIG. 15 is an exploded perspective view of another embodiment of a convertible child-resistant closure assembly of the present invention.
Figure 16:
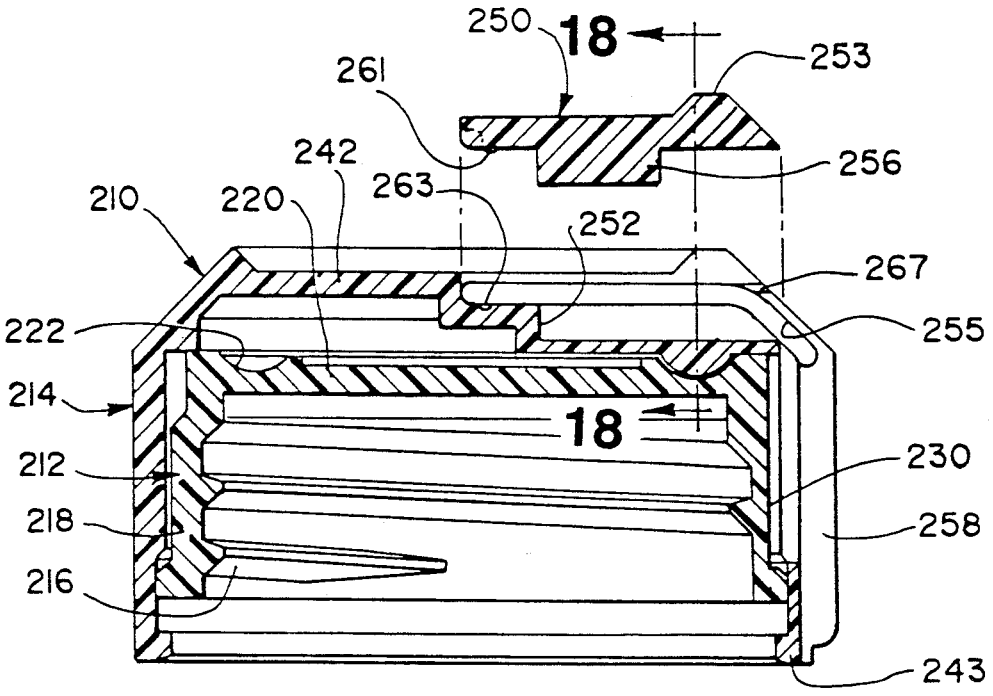
FIG. 16 is a partial cross-sectional view of FIG. 15.
Figure 17:
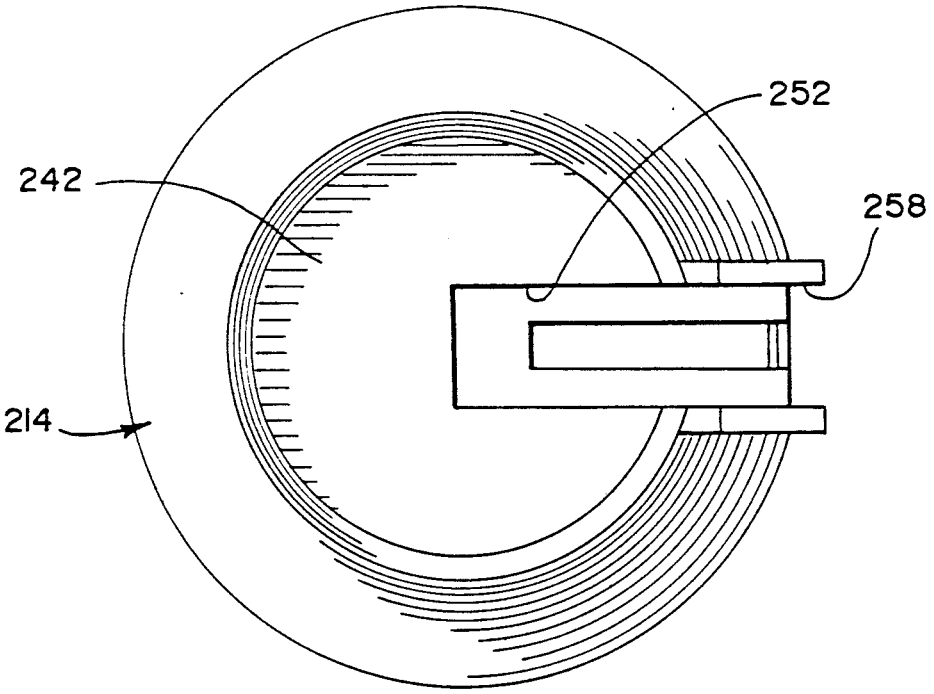
FIG. 17 is a plan view of the shell of FIG. 15.

The closure 112 is generally cylindrical and defines a side wall 118 mounting threads 116 and a top 120. A compressible liner may be used as well. Top 120 may define an annular groove 122, which, as best seen in FIGS. 13 and 14, also defines a stop 124 having a sloping surface 126 on the counterclockwise side of stop 124 and a projecting finger 128 on the clockwise side. The side wall 118 also defines recess means such as a latching slot 130 positioned in a predetermined location relative to finger 128, such as in alignment therewith as seen in FIG. 13. Finger 128 is of minimal thickness and as seen in FIG. 13 is not connected to the closure walls at its sides. This is a molding aid to allow finger 128 to flex upwardly during parting of the mold. Furthermore, as seen in FIGS. 11 and 12, slot 130 is closed at the top by a shoulder 131 to locate the parts in a precise relationship vertically and to preclude the key from entering the latching slot 130 until the underside of the top surface of the shell is in contact with the upper surface of the closure.

The outer shell 114 is adapted to closely fit on closure 112 and to rotate relative thereto. Outer shell 114 comprises a generally cylindrical side wall 140 and a top 142 overlying the closure top 120. The shell 114 also defines a retaining flange, like flange 43, to maintain the relationship of shell 114 and closure 112 and to prevent them from being separated, one from the other. The lower, inner side of the shell top 142 facing the closure top 120 inter alia provides a depending stop or drive member 144 which has a sloping surface 146 on the counterclockwise side and a projecting finger 148 which is complementary to surface 128 on the clockwise side of stop 124 and which is configured to interdigitate therewith. As may be seen from the drawings stop 124 and drive member 144 are wider than corresponding members 24, 44 to provide a greater bearing surface in operation. Thus, when the closure assembly 110 is to be used to secure and tighten the closure on a bottle via threads 116, the projecting fingers engage as shown in FIG. 14 for movement in a clockwise direction. The fingers 128, 148 interlock or interdigitate to facilitate tightening of the closure on a bottle as well as to keep the threaded closure and shell from disengaging when the key is in latching slot 130. However, on their counterclockwise sides the surfaces 126, 146 are sloping or sufficiently inclined, such that unthreading of the closure 112 from the bottle is exceedingly difficult, i.e., the sloping surfaces simply ride over each other. Preferably the inclines of surfaces 126, 146 do not match to minimize the possibility that frictional engagement might assist in defeating the child-resistant function of the closure assembly.

The stop 124 and drive member 144 serve also as an aligning means to provide a locating or aligning function in which latching means are aligned for latching engagement. As may best be seen in FIG. 11 shell 114 hingedly mounts an integrally formed latching or locking key 150. Key 150 is normally disposed in a notch 152 on the top of shell 114 (as in the manner shown in FIG. 5), preferably in a snug fit sufficient to keep it from being jarred loose. In that position key 150 is inactive and the closure assembly 110 is in its child-resistant or secure mode. It should be noted that the lengths of the fingers are such that they prevent the key from engaging the associated notch 152 when the shell is rotated in a counterclockwise direction. By the time the fingers clear each other in counterclockwise rotation, the keyway and notch are no longer in alignment.

Figure 11:
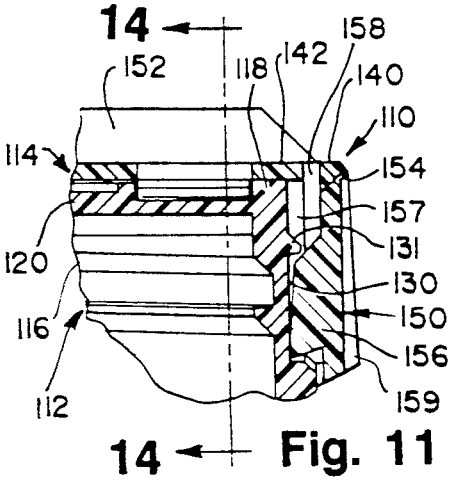
FIG. 11 is a fragmentary cross-sectional view of a further embodiment of a closure assembly of this invention, like that shown in FIGS. 1 to 8, and showing the closure and shell latched in a non-child-resistant position.

Latching key 150 is pivotally movable from its inactive or storage position in notch 152 about a hinge, such as living hinge 154 (through intermediate positions like those illustrated in dotted line in FIG. 5), to a position in which it may bear against the side wall 118 in a converted, active slot engaging position best shown in FIG. 11. The intermediate dotted line position of FIG. 5 also represents the position of the key 150 as it is molded. In the slot engaging position of FIG. 11, latch 156 which projects inwardly of key 150 extends through shell opening 157 and is positioned in latching slot 130, and the key 150 is preferably releasably held in a recess 158 in a friction fit, or by a retaining undercut (not shown).

Desirably the upper surface portions of key 150 is slightly curved in cross-section (as in the manner shown in FIG. 7) to conform to the curvature of the recess 158. When latch 156 is positioned as described, it interlocks the closure 112 and shell 114 so that they are corotatable in both clockwise and counterclockwise directions, i.e., they are in a security disengaged, non-child-resistant mode relative to each other. In that mode the closure assembly acts like an ordinary threaded bottle closure and permits easy opening and closing of the bottle. Desirably the shell 114 may define an extended recess 158 at the outer surface of side wall 140 so that when the latch 156 is in the position typified by FIG. 8, against the side wall 118 of closure 112, away from latching slot 130, the remainder of the key 150 lies within the recess 158. Further, the key 150 and recess 158 are proportioned so that the key 150 may not be pushed inwardly with sufficient force to remove the shell from the closure 112 As in the embodiment of FIGS. 1-8, the bottoms of the side wall portions 159 of recess 158 terminate above the bottom end of the shell and are curved to facilitate pushing the key into the latching slot.

To return the closure assembly to its child-resistant, security engaged mode, the key 150 needs simply to be retracted from the latching slot 130 as by engaging the lower end of the key with a finger, lifting the key free, and then returning it to the storage position typified by FIG. 5.

To locate the latch 156 in a position in which it confronts latching slot 130, the shell 114 is rotated in a clockwise direction. This continues until the stops, namely the stop 124 and drive member 144, engage, at which time the latch 156 confronts the latching slot 130 and may be pushed home thereunto. Alternatively, the key 150 may be moved to the position where it bears against the side 118 of the closure 112 and then the shell may be rotated, while pushing on the key until it engages the slot 130 at which time the latch 156 may be pushed home into the slot 130.

Yet another embodiment of the present invention is shown in FIGS. 15-19. Except for the latching key arrangement, it is very much like the embodiment of FIGS. 1 to 8. Thus, convertible child-resistant closure assembly 210 comprises a threaded closure 212 and an overlying outer shell 214. The shell 214 mounts the closure therewithin and is rotatable on and relative to the closure 212. The height of the closure 212 is less than the inside height of shell 214 so that the shell may be moved vertically relative to the closure.

Closure 212 is generally cylindrical and defines a side wall 218 mounting threads 216 and a top 220 defining an annular groove 222 and a stop 224 having a sloping surface 226 on the counterclockwise side of stop 224 and a surface 228 which is slightly forwardly inclined on the clockwise side. These are shown in FIG. 4 which is slightly forwardly inclined on the clockwise side. The side wall 218 also defines recess means such as a latching slot 230 aligned with stop surface 228.

Outer shell 214 comprises a generally cylindrical side wall 240 and a top 242 overlying the closure top 220. The shell 214 also defines a retaining flange 243 to maintain the relationship of shell 214 and closure 212 and to prevent them from being separated, one from the other. The lower, inner side of the shell top 242 facing the closure top 220 inter alia provides a depending stop or drive member 244 which has a sloping surface 246 on the counterclockwise side and a surface 248 which is inclined complementary to surface 228 on the clockwise side of stop 224. When the closure assembly 210 is to be used to secure and tighten the closure on a bottle via threads 216, the surfaces 228, 248 engage for movement in a clockwise direction. The surfaces 228, 248 are somewhat inclined to facilitate tightening of the closure on a bottle as well as to keep the threaded closure and shell from slipping past each other vertically when the key is in latching slot 230. However, on their counterclockwise sides the surfaces 226, 246 are sloping or sufficiently inclined, such that unthreading of the closure 212 from the bottle is exceedingly difficult, i.e., the sloping surfaces simply ride over each other. Preferably the inclines of surfaces 226, 246 do not match to minimize the possibility that frictional engagement might assist in defeating the child-resistant function of the closure assembly.

The stop 224 and drive member 244 serve also as an aligning means to provide a locating or aligning function in which latching means are aligned for latching engagement. As seen in the drawings shell 214 mounts latching or locking key 250. Key 250 is normally disposed in a notch 252 on the top of shell 214, preferably in a snug fit sufficient to keep it from being jarred loose. In that position key 250 is inactive and the closure assembly 210 is in its child-resistant or secure mode.

In this embodiment the latching key 250 is slideably rather than hingedly connected and secured to the outer shell 214. It is movable along the outer surface of the shell from its inactive or storage position in notch 252 through intermediate positions shown in FIG. 19 in dotted line to a final position in which it is in its converted, active slot engaging position represented in FIG. 19. In the slot engaging position, latch 256 which projects inwardly of key 250 extends through shell opening 257 and is positioned in slot 230. Key 250 is preferably held in recess 258 in a friction fit.

When latch 256 is positioned as described, it interlocks the closure 212 and shell 214 so that they are corotatable in both clockwise and counterclockwise directions, i.e., they are in a security disengaged, non-child-resistant mode relative to each other. In that mode the closure assembly acts like an ordinary threaded bottle closure and permits easy opening and closing of the bottle. Desirably the shell 214 may define an extended recess 258 at the outer surface of side wall 240 so that when the latch 256 is in the non-child-resistant mode, the remainder of the key 250 lies within the recess 258. Further, the key 250 and recess 258 are desirably proportioned so that the key 250 may not be pushed inwardly with sufficient force to remove the shell from the closure 12.

To return the closure assembly to its child-resistant, security engaged mode, the key 250 needs simply to be retracted from the latching slot 230 as by engaging the end 260 of the key with a finger, lifting the key free, and then returning it to the storage position.

To locate the latch 256 in a position in which it confronts latching slot 230, the shell 214 is rotated in a clockwise direction. This continues until the stops namely the stop 224 and drive member 244, engage, at which time the latch 256 confronts the latching slot 230 and may be pushed home thereunto. Alternatively, the key 250 may be moved to a position against the side wall 218 and then the shell may be rotated, while pushing on the key until it engages the slot 230 at which time the latch 256 may be pushed home into the slot 230.

As may be appreciated latching key 250 is separately formed. It is flush with the top surface of the shell. The latch 256 is hidden from view (as contrasted with the embodiments utilizing the hinged keys) resulting in a more aesthetically pleasing design. It also obscures the presence and function of the key, diminishing the likelihood of accidental actuation.

Figure 18:
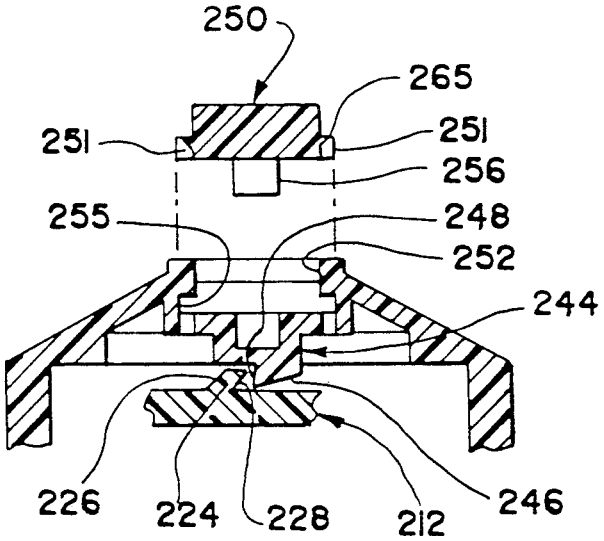
FIG. 18 is a fragmentary cross-sectional view taken substantially along line 18—18 of FIG. 16.
Figure 19:
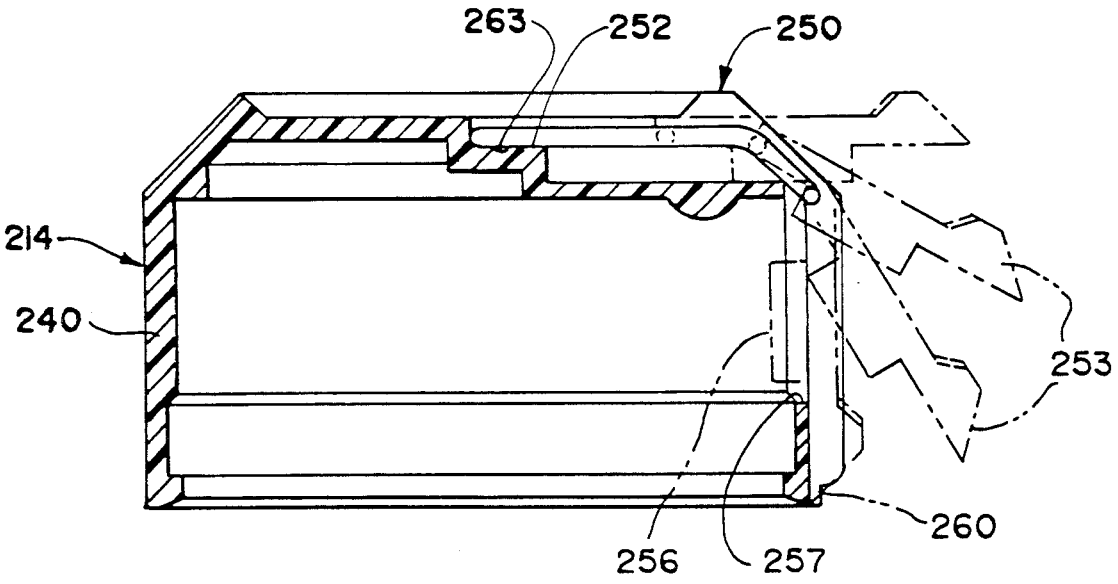
FIG. 19 is a view similar to FIG. 16 showing the latching key in several positions.

Key 250 includes a pair of pins 251 and a finger tab 253 for moving the key to and from the desired positions of usage. Pins 251 are disposed in slots 255 formed in the walls of the shell and in which the pins travel. As seen in FIG. 18, the bottoms of slots 255 are open to facilitate molding. To operate the key, it is slid forwardly along the upper surface of notch 252 from its storage position until the pins reach the forward end of the slots 255. At that time, the latching key may be pivoted downwardly, and the latch 256 may be pushed inwardly of the shell opening 257 and finally, when the aligning members 224, 244 are properly aligned, into the closure slot 230, thereby to lock the closure and shell together in the converted, active non-child-resistant position.

The latching key 250 may define a depending dimple or projection 261 and the notch a corresponding matching recess 263. These tend to hold the key in an inactive child-resistant position, providing resistance to overriding such and to sliding movement of the key 250.

Additionally, key 250 defines a pair of splines 265 which are spaced forwardly of the pins 251. The shell 214 defines complementary grooves 267 into which the splines 265 snap fit. These keep the key from pivoting upwardly and also assist in retaining the key in the notch 252. When the key is moved forwardly out of the inactive child-resistant position, splines 265 move out of the grooves 265 as the pins reach the depending 45° angled portion of the slots 255.

Although the embodiment of FIGS. 15–19 show that pins 251 are provided on the key, it is apparent that pins can instead be provided on the shell and appropriate slots on the key to provide for sliding and pivoting movement of the key on the shell. It is also apparent that the spring finger feature of FIG. 10 and the alignment and stop structure of FIGS. 11 to 14 may be utilized in the embodiment of FIGS. 15–19.

The embodiments of this application may be shipped in an assembled condition, ready for assembly to a bottle or container without alteration. In fact, the embodiments, and particulary that of FIGS. 15–19, may be assembled to threaded bottles or containers with current capping equipment, with little or no modification to the capping equipment.

It will be apparent to those skilled in the art that other and further embodiments and changes may be made in accordance with the present invention. Accordingly, the invention is not to be considered as being limited, except as may be necessitated in accordance with the claims.

What is claimed is:

1. A convertible child-resistant closure assembly comprising a threaded closure and an overlying outer shell mounting said closure therewithin;

a latching key mounted on said shell for movement between an inactive child-resistant position and a converted, active non-child-resistant position;

complementary latching means on said closure for releasably engaging said latching key in said active position in which said shell and closure are corotatable in both clockwise and counterclockwise directions, and wherein when said latching key is in said inactive position, said shell and said closure are not corotatable in said counterclockwise direction; and wherein said closure and shell define complementary interengaging aligning means for aligning said latching key and complementary latching means in said active position, said aligning means comprising respective stops on the upper surface of said closure and a confronting surface of said shell, said stops having confronting inclined surfaces to prevent relative vertical movement of said stops when said latching key and latching means are in said active position.

2. A convertible child-resistant closure assembly in accordance with claim 1, and wherein said latching key is hingedly mounted on said shell.

3. A convertible child-resistant closure assembly in accordance with claim 1, and wherein said latching key is slideably mounted on said shell.

4. A convertible child-resistant closure assembly in accordance with claim 3, and wherein said latching key includes pins and said shell defines slots receiving said pins for permitting sliding of said key on said shell.

5. A convertible child-resistant closure assembly in accordance with claim 4, and means on said latching key for resisting sliding movement of said latching key from said inactive position and for resisting vertical movement of said latching key out of said inactive position.

6. A convertible child-resistant closure assembly in accordance with claim 1, and wherein said closure is of a first height less than the height of the overlying shell to permit relative vertical movement therebetween, and spring means on one of said closure and shell for maintaining said stops in a vertically spaced relationship whereby a downward force on said outer shell will overcome the force of said spring means to permit said stops to be moved into a non-vertically spaced relationship.

7. A convertible child-resistant closure assembly in accordance with claim 6, and wherein said spring means comprise a plurality of resiliently deflectable spring fingers.

8. A convertible child-resistant closure assembly in accordance with claim 1, and wherein said stops also function to permit said closure and shell to corotate in the clockwise direction, but to prevent corotation thereof in the counterclockwise direction.

9. A convertible child-resistant closure assembly in accordance with claim 1, and wherein said latching means comprises a latching slot in said closure, and said latching key extends through the shell and into said latching slot in said closure in said active position.

10. A convertible child-resistant closure assembly in accordance with claim 1, and wherein said closure is of a first height less than the height of the overlying shell to permit relative vertical movement therebetween, and spring means on one of said closure and shell for maintaining said stops in a vertically spaced relationship whereby a downward force on said outer shell will overcome the force of said spring means to permit said stops to be moved into a non-vertically spaced relationship.

11. A convertible child-resistant closure assembly in accordance with claim 10, and wherein said spring means comprise a plurality of resiliently deflectable spring fingers.

12. A convertible child-resistant closure assembly comprising a threaded closure and an overlying outer shell mounting said closure therewithin;

a latching key mounted on said shell for movement between an inactive child-resistant position and a converted, active non-child-resistant position;

complementary latching means on said closure for releasably engaging said latching key in said active position in which said shell and closure are corotatable in both clockwise and counterclockwise directions, and wherein when said latching key is in said inactive position, said shell and said closure are not corotatable in said counterclockwise direction; and wherein said closure and shell define complementary interengaging aligning means for aligning said latching key and complementary latching means in said active position, said aligning means comprising respective stops on the upper surface of said closure and a confronting surface of said shell, said stops having confronting interdigitated fingers to prevent movement of said stops when said latching key and latching means are in said active position.

13. A convertible child-resistant closure assembly in accordance with claim 12, and wherein said latching key is hingedly mounted on said shell.

14. A convertible child-resistant closure assembly in accordance with claim 12, and wherein said latching key is slideably mounted on said shell.

15. A convertible child-resistant closure assembly in accordance with claim 14, and wherein said latching key includes pins and said shell defines slots receiving said pins for permitting sliding of said key on said shell.

16. A convertible child-resistant closure assembly in accordance with claim 15, and means on said latching key for resisting sliding movement of said latching key from said inactive position and for resisting vertical movement of said latching key out of said inactive position.

17. A convertible child-resistant closure assembly in accordance with claim 12, and wherein said stops also function to permit said closure and shell to corotate in the clockwise direction, but to prevent corotation thereof in the counterclockwise direction.

18. A convertible child-resistant closure assembly in accordance with claim 12, and wherein said latching means comprises a latching slot in said closure, and said latching key extends through the shell and into said latching slot in said closure in said active position.

* * * * *